United States Patent [19]

Gray

[11] Patent Number: 4,677,405

[45] Date of Patent: Jun. 30, 1987

[54] FEEDS FOR TRANSMISSION LINES

[75] Inventor: Philip J. Gray, Chelmsford, England

[73] Assignee: The General Electric Company plc, London, England

[21] Appl. No.: 765,968

[22] Filed: Aug. 15, 1985

[30] Foreign Application Priority Data

Aug. 22, 1984 [GB] United Kingdom ..... 8421312

[51] Int. Cl.[4] ..... H01P 5/00

[52] U.S. Cl. ..... 333/245; 333/1; 333/261

[58] Field of Search ..... 333/115, 237, 245, 261.1, 333/243; 343/763

[56] References Cited

U.S. PATENT DOCUMENTS

| | | | |
|---|---|---|---|
| 2,408,435 | 10/1946 | Mason | 333/237 X |
| 2,763,777 | 9/1956 | Smullin | 333/115 X |
| 2,925,565 | 2/1960 | Cook et al. | 333/115 X |

*Primary Examiner*—Paul Gensler

*Attorney, Agent, or Firm*—Spencer & Frank

[57] ABSTRACT

Apparatus and method for transmitting microwave energy to or from a coaxial cable transmission line. A conductive ring is positioned between and spaced from the inner and outer conductors. The ring has two diametrically opposed conductive stubs extending laterally outwardly therefrom. One stub extends through and is electrically separate from the outer conductor. The other stub extends to and is electrically connected with the outer conductor.

6 Claims, 5 Drawing Figures

FEEDS FOR TRANSMISSION LINES

BACKGROUND OF THE INVENTION

1. Field of the Invention

This invention relates to feeds for transmission lines, and concerns in particular methods of and apparatus for supplying a coaxial cable transmission line with microwave energy in circularly symmetric, TEM, mode.

2. Description of the Prior Art

There are many occasions in the field of microwave electronics when it is desired to transfer microwave energy into a coaxial cable transmission line in circularly symmetric (Transverse Electromagnetic) mode. One such occasion that frequently occurs is in low power radar systems, wherein rotating joints are employed in the transfer of microwave electromagnetic radiation energy between two sections of apparatus one of which rotates relative to the other, as now explained in more detail.

It is common, in microwave transceiving apparatus of the type used in a radar system, for the signals to be transmitted to be transferred from one or more microwave signal generators/transmitters to a physically separate aerial from which they are to be radiated. In many radar systems the aerial may be required to rotate about a vertical and/or horizontal axis, so as to radiate the energy in a succession of different directions, and in some of these systems—particularly those where the aerial rotates continuously in one direction—it is necessary to transfer the microwave energy via the mechanical joint by which the aerial is mounted for rotation upon a base portion stationary relative to the ground. In a radar employing fairly low energy microwaves in the centimetric/metric wavelength range (say, in the L to C band range, or from 30 cm down to 6 cm) the energy will commonly be transferred along coaxial cables (rather than waveguides) and in such a case the joint is conveniently constructed as a series of coaxial tubular conductors, each constituting a physically separate channel, sufficient in number to enable each conductor to carry one of the signals to be transferred. With this construction, the innermost joint conductor (a first channel) is connected to the centre conductor of the first one of the coaxial cables feeding the joint (so "continuing" the cable through the joint), while the next joint conductor (a second channel) is connected both to the outer conductor of that first cable and to the inner conductor of a second cable, the *next* joint conductor (a third channel) is connected both to the outer conductor of the second cable and to the inner conductor of the third cable . . . and so on until the outermost joint conductor is connected only to the outer conductor of the final cable.

One acceptable way of feeding the microwave energy to the joint conductors (other than the innermost) is the well-known "stub-supported" fashion. In this, a laterally-extending stub of the relevant conductor is positioned along the conductor about $\lambda/4$ (where $\lambda$ is the mean free-space wavelength of the desired signal bandwidth) from a short to the relevant outer conductor, and the energy is supplied to the conductor via the stub (the $\lambda/4$-spaced short "supports" the stub, assisting in the proper launching of energy along the conductor). There are, however, problems associated with this arrangement, as is now explained.

When microwave energy is transferred between the stationary and rotating sections of a tubular rotating joint it is important that the relative angular position of the two joint sections play no part in determining how much energy is transferred. This can be achieved by arranging that the energy distribution around the tube be uniform (so that there is no angular dependency at the moment of transfer), and this uniformity, or circular symmetry, describes the pure transverse electromagnetic mode—TEM—of energy propagation. Unfortunately, the presently-preferred method of feeding the energy to the tubular conductor—thus, using a stub—is inherently asymmetric, and guarantees that a component of the resulting field will itself propagate asymmetrically. Luckily, this proportion is low, and decays rapidly (in an exponential manner), but even so to prevent its transfer across the joint the length of conductor between the input and output stubs must be relatively large to assure the asymmetric component's decay to an acceptably low level before the transferred energy is launched into the line fed by the output side of the joint.

This need to have a significant length of conductor between the two stubs in a stub-supported joint, coupled indeed with the $\lambda/4$ length of conductor beyond the stub at each end, means that stub-supported joints are considerably longer than is desirable bearing in mind the general need always to have the equipment occupy the smallest possible space. The invention seeks to deal with this length problem by utilizing a different, and novel, method of and apparatus for supplying the energy to each joint conductor—which is indeed applicable to the launching of microwave energy into any coaxial cable transmission line—where there is employed a conductive feed ring (or short tube) positioned around and spaced from the conductor, and this ring is itself fed by a stub and is shorted to the relevant outer joint conductor at a point diametrically opposite the stub.

BRIEF SUMMARY OF THE INVENTIVE CONCEPT

In one aspect, therefore, this invention provides a method of transferring microwave energy to or from a coaxial cable transmission line, in which method a conductive ring is positioned between but spaced from the line's inner and outer conductors, and at one circumferential position is electrically connected (shorted) to the tube's outer conductor, and the energy is transferred to or from this ring via a conductive stub extending laterally outwardly therefrom at a position diametrically opposite the short to the outer conductor.

In another aspect, the invention provides apparatus for transferring microwave energy to or from a coaxial cable transmission line, which apparatus includes a conductive ring positioned between but spaced from the line's inner and outer conductors, the ring having two diametrically opposed conductive stubs extending laterally outwardly therefrom, one stub extending through and electrically separate from the conductor, the other extending to and electrically connected with the outer conductor.

DETAILED DESCRIPTION OF THE INVENTIVE CONCEPT

The invention concerns the transfer of energy to or from a coaxial cable transmission line. Naturally, it may be of use in both—that is, in the feeding of energy into the line and in the subsequent withdrawing of energy from the line some distance away from the input point.

In each case the transfer is preferably effected using a ring and stub arrangement according to the invention.

In principle, the nature of the line may be of any sort, but the invention is of particular use in the context of rotating joints (as found in many radar systems), and in such a case the following factors of preference are relevant.

Firstly, the line itself is in the form of one rigid tubular conductor coaxially within but spaced from another.

Secondly, when transferring energy both into and subsequently out of the line the conductors will, somewhere between the input and output points, be physically broken—that is to say, each is separated into two associated but physically unconnected conductors—so as to allow one side of the joint to rotate relative to the other, but (because of the usual sort of chokes employed) will present electrically an unbroken pathway for the energy between the two sides of the joint.

Thirdly, it is common for rotating joints to carry a plurality of physically separate channels (conventionally comprised of for the first channel a "solid" inner conductor with an outer tubular conductor, which latter then forms for the second channel a tubular inner conductor having its own tubular outer conductor, and so on until there are sufficient coaxial conductors to constitute the desired number of channels). The invention is applicable to such a situation—thus, one wherein around a "solid" inner (core) conductor there is a plurality of coaxial tubular conductors between each adjacent pair of which is a conductive ring with a stub extending through the outer conductor of the pair (and through all the subsequent outer conductors) and shorted opposite the stub to the inner conductor of that pair.

Fourthly, it may often be the case that the or each coaxial cable transmission line is carrying low energy signals across a joint through which there is simultaneously being carried high energy signals along a waveguide section also forming part of the joint. In such a case it is convenient for the or each coaxial tubular conductor for the low-energy signals to be centrally located within a tubular waveguide portion carrying the high energy signals across the joint, and then the physical size, and number, of the tubular conductors will be limited by the conductive surface defining the inner face of the tubular waveguide.

The invention employs a conductive ring between the inner and outer conductors of the or each line. Within certain limits it would seem as though the ring can be of any diameter, thickness (in a radial direction) and length (in an axial direction), but the situation is complex, the ring dimensions, the coaxial line dimensions and the operating wavelength are all interlinked, and the following general comments are for guidance only.

If the coaxial input to the ring is of 50 ohms impedance then the characteristic impedance of the coaxial line should also be 50 ohms. The coaxial line size is generally (but not necessarily) chosen to be as large as possible while maintaining an adequate operating safety margin to the cut-off of the first high order coaxial mode ($TE_{11}$ *mode*).

The dimensions of the ring can be chosen such that the mean circumferential length of the ring is between one quarter and one half wavelength at the design centre wavelength. The axial length of the ring does not appear to be critical, and in general there is a linear relationship between the operating wavelength and this axial length. Two such cases are a length of 12 mm for a wavelength of 28.5 cm and 5 mm for a wavelength of 20.3 cm. Both these cases are for a coaxial line of inner conductor diameter 18 mm and an outer conductor diameter of 41.42 mm.

To excite the TEM mode in the coaxial line the ring is shunt stub supported by a section of short-circuited coaxial line. For the case of a single ring launching into a line terminated in its characteristic impedance this shunted stub is ideally one quarter wavelength long at the design centre wavelength.

Having said all that, the mean circumference of the ring is very preferably about $\lambda/2$ (where $\lambda$ is again the free-space wavelength at the centre of the bandwidth), and in one particular case where low power signals with a bandwidth centre of 18.8 cm are transferred to and from a coaxial cable transmission line with an inner conductor outer diameter of 16.6 mm and an outer conductor inner diameter of 38.2 mm there can best be used a ring of 25.8 mm mean diameter, 2 mm radial thickness and 9 mm axial length.

According to the invention the ring is shorted (by an outwardly extending conductive stub) at one position around its circumference to the outer conductor, and is connected at the circumferential position diametrically opposite the short to an outwardly extending conductive stub reaching without electrical contact to and through the outer conductor (and eventually to a source—or drain, as appropriate—of the microwave energy being transferred). Each stub extends laterally from the ring, and indeed is conveniently radial thereto.

As can easily be understood, the ring, with its stub, is itself a short length of "tubular" conductor, and as such is very similar to those presently-used stub-supported devices mentioned above. Accordingly, it might be expected that the energy distribution around the ring would necessarily be asymmetric, and thus that the energy launched into the tubular inner conductor would also be asymmetric. However, by virtue of the symmetric arrangement of the input, the ring, and the shorting stub diametrically opposite the input, the TEM mode purity is higher than in the Prior Art stub-supported design. The shorting conductive stub, since it is placed diametrically opposite the input, effectively prevents the generation of antiphase voltage fields that excite the first higher order coaxial mode ($TE_{11}$ mode) which has asymmetric field patterns. Since the generation of the $TE_{11}$ mode is a function of the mean circumferential length of a chosen coaxial line and the operating wavelength, the effect of the shorting stub and the ring itself is to reduce the available mean circumferential length for $TE_{11}$ propagation, hence pushing the cut-off frequency to this mode further away from the operating band and raising the cut-off attenuation and hence increasing mode purity to the TEM mode.

As described so far the invention has assumed the use of conventional tubular components. However, it can be realized in stripline form, in which case the following alterations or additional comments should be made.

The input line, the ring arrangement and the shorting stub can all be realized in a planar stripline form using conventional stripline construction techniques. The characteristic impedance of the stripline equivalent is the same as for the tubular joint already described. The ring is shunt stub supported by a section of short-circuited line, but whereas in the tubular joint this is of coaxial line construction, in the stripline joint this line is of radial construction. Furthermore, in the stripline joint the planar network, consisting of the input line, the ring itself and the shorting stub, is placed within the shunt stub section of radial line, and is not physically separated as with the tubular joint.

Using the techniques of the invention microwave energy may be transferred to and from a coaxial cable transmission line without some of the problems associated with the present stub-supported systems. In particular, there may be constructed a rotating joint (across which the energy is transferred from the stationary side to the rotating side) which is significantly shorter than hitherto possible. This is achieved by placing two ring arrangements (input, ring and stub section of line) in a back-to-back configuration, with an electrically choked mechanical break separating the two rings such that relative rotation can take place between the two halves. Apart from the preferred sizes of ring, coaxial line and their relationship with the operating wavelength, there exists a preferred spacing between the ring centres and also a preferred length of stub section of short circuited line such that bandwidth and electrical performances are maximized.

Ideally the ring spacing is one quarter free space wavelength ($\lambda/4$) with the shorted stub being one eighth free space wavelength ($\lambda/8$) at the design centre wavelength. This is to say that the total length of the rotating joint is one half of a free space wavelength ($\lambda/2$), and is significantly shorter than a Prior Art stub-supported arrangement.

One such arrangement for transferring signals at a wavelength of 18.8 cm can have a ring centreline spacing of 4.7 cm with an overall rotating joint length of 9.4 cm. The bandwidth of this arrangement is 40% for a return loss performance of better than 21 dB with a cut-off attenuation to the asymmetric $TE_{11}$ *'mode of* 36 dB. In contrast, the Prior Art stub-supported design with input and output spaced by 4.7 cm in the same line size yields a cut-off attenuation of only 24.5 dB.

Furthermore, it is possible to reduce the length between the rings and the length of the shorted sections of coaxial line, where a narrower operating bandwidth can be tolerated. The relationship of the ring spacing to the overall rotating joint length is of a linear nature, and is only bounded by the acceptable pass band performance.

One such example of this forshortening is a ring centreline spacing of $0.2\lambda$, a total rotating joint length of $0.4\lambda$, a centre operating wavelength of 28.5 cm, a 21 dB return loss bandwidth of 13%, and a cut-off attenuation to the asymmetric $TE_{11}$ mode of 31 dB.

BRIEF SUMMARY OF THE DRAWINGS

Various embodiments of the invention are now described, though only by way of illustration, with reference to the accompanying Drawings in which.

DETAILED DESCRIPTION OF THE DRAWINGS

Figure 1:
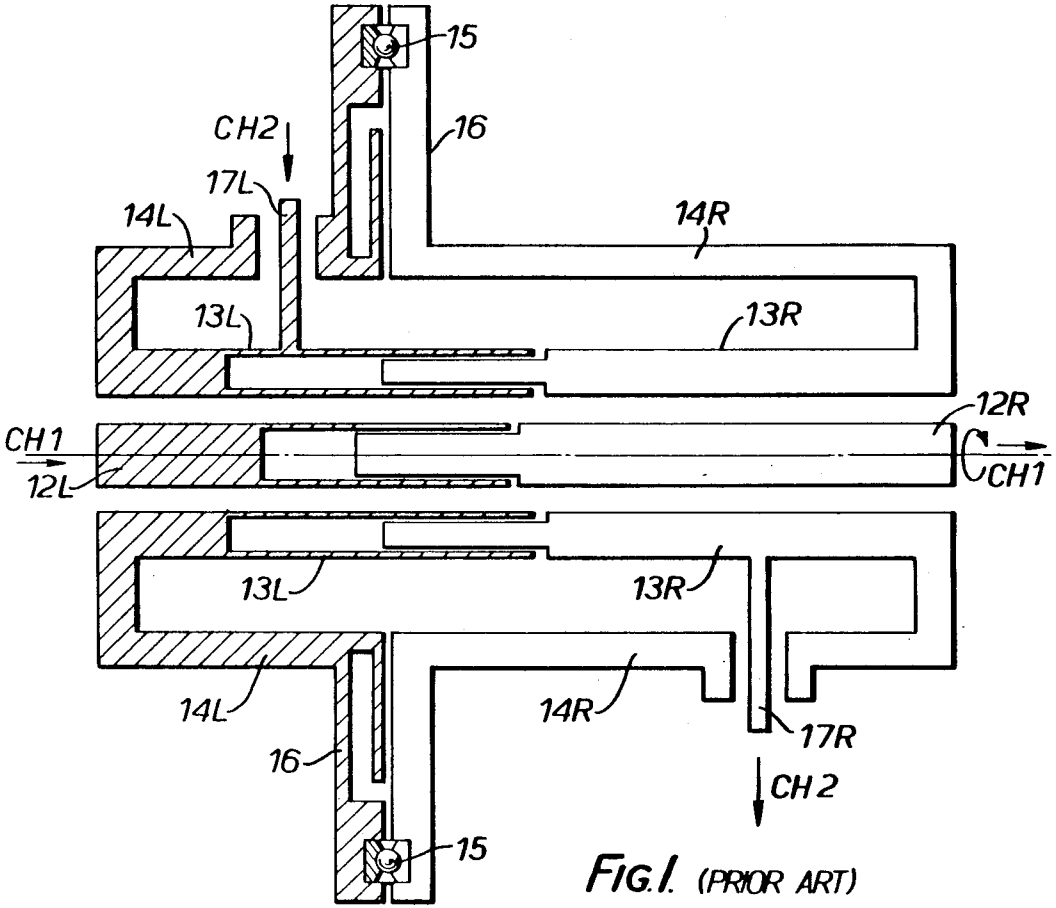
FIG. 1. (PRIOR ART)
FIG. 1 is a diagrammatic axial cross-section through a conventional Prior Art stub-supported tubular rotating joint.

The Prior Art joint of FIG. 1 is a conventional stub-supported two-channel tubular rotating joint. It has a stationary end (on the left as viewed, and shown hatched) and—physically spaced therefrom but effectively electrically contiguous therewith—a rotating end (on the right as viewed, and shown unhatched), and is supporting two channels for energy transmission. The first channel is comprised of a "solid" conductive core (12L, 12R) together with a surrounding conductive tube (13L, 13R), while the second channel is the tube 13L, R and the surrounding conducting tube (14L, 14R). The various parts in each half are supported together (by means not shown), and the two halves are themselves mounted via bearings (15) in a radial flange (16).

The second channel is stub-fed; energy is fed to the input side of the inner tube 13L via a radially-extending conductive stub (17L), and the energy transferred across the joint to the output side of the inner tube 13R is withdrawn from a like stub (17R). In order that this feeding and withdrawing should be optimized, the two tubes 13, 14 extend outwardly from the joint beyond the stub 17L, 17R, for a distance of $\lambda/4$ (where $\lambda$ is, as stated before, the mean free-space wavelength of the joint's intended operating waveband). Moreover, in order that the asymmetric component of the launched energy decay sufficiently between the two stubs the actual distance therebetween is (at least) $\lambda/2$. At the very least, therefore, the joint is $2\times\lambda/4+\lambda/2=\lambda$ long—which, for a $\lambda$ of 28.5 cm, is 28.5 cm.

Figure 2A:
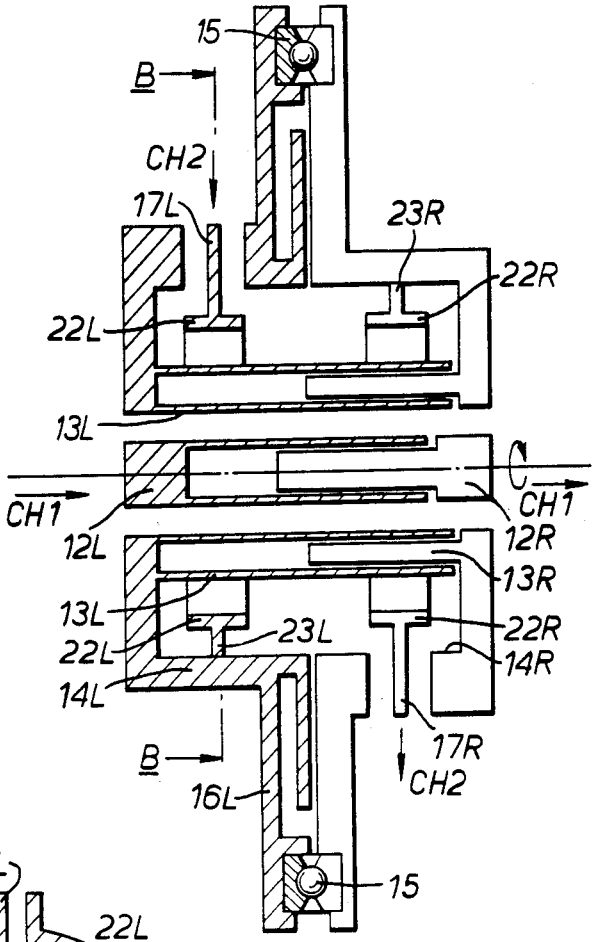
FIG. 2A is a diagrammatic axial cross-section through a tubular rotating joint of the invention.
Figure 2B:
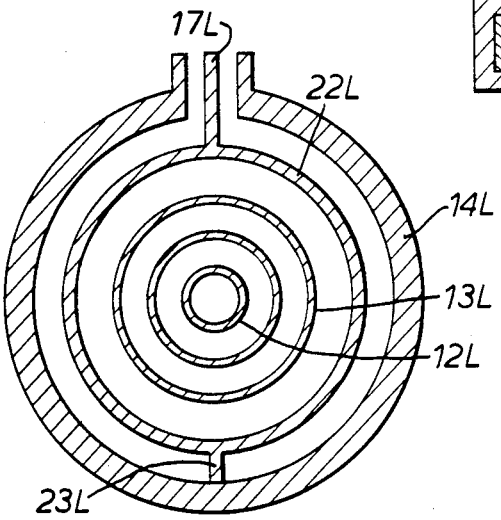
FIG. 2B is a trans-axial view of the FIG. 2A joint similar to one on the line B—B of FIG. 2A.

FIGS. 2A, 2B show views of a joint according to the invention. The joint is in effect like that of FIG. 1 (and similar parts have the same reference numerals), but is considerably shorter! As can be seen, the two stubs 17L, 17R do not extend from/to the inner tube 13L, 13R but instead each goes from/to an intermediate conductive ring—a short length of conductive tube (22L, 22R) mounted (by means not shown) coaxially between the inner and outer tubes 13L, 14L and 13R, 14R respectively. Each ring 22 is shorted to the relevant outer tube 14 section by a short stub (23L, 23R) opposite each stub 17L, 17R. As explained in detail hereinbefore, the spacing between the two rings 22 is $\lambda/4$ while the spacing between each ring 22 and the relevant joint end (where the inner and outer tubes are shorted) is $\lambda/8$; the overall length of the joint is thus only $\lambda/2$.

Figure 3A:
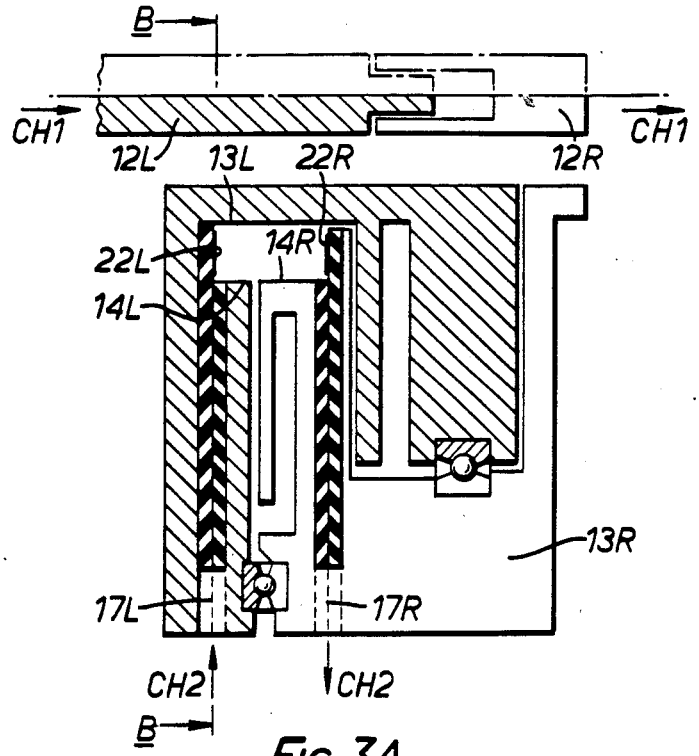
FIG. 3A is "half" of a diagrammatic axial cross-section through a stripline rotating joint similar in effect to the tubular joint of FIG. 2A.
Figure 3B:
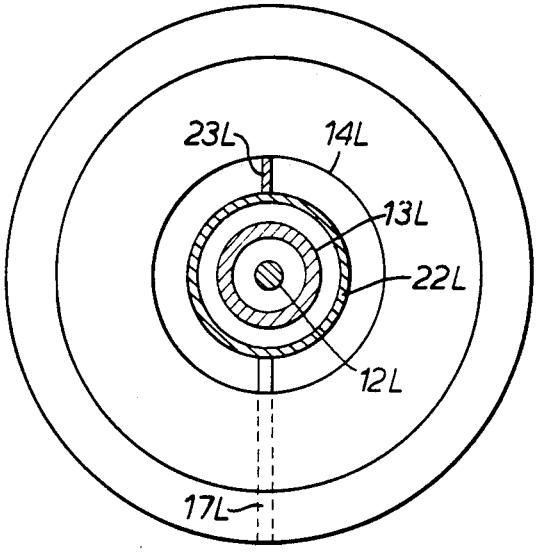
FIG. 3B is a trans-axial view of the FIG. 3A print similar to one on the line B—B of FIG. 3A.

In FIGS. 3A, 3B there is shown a stripline form of the inventive rotating joint of FIGS. 2A, 2B. Though it is not at first sight easy to see, the correspondence between the two is as follows:

The conductive rings (22L, 22R) have been replaced by a stripline planar form with the two stubs (17L, 17R) also in planar form but lying in the rotating joint transmission line formed by the stripline ground planes and the inner and outer tubes 13L, 14L and 13R, 14R. The stripline network is folded such that the rotating joint is partially of coaxial form and partially of radial form. Each ring 22 is shorted to the relevant outer tube 14 section by a stripline shorted stub 23L, 23R (not shown) opposite each stub 17L, 17R. The spacing between each ring is ideally $\lambda/4$, this being now the total physical length of the joint since the shorted sections of line stub supporting the rings are now in radial form.

This makes the joint *very* much shorter than the Prior Art joint of FIG. 1.

I claim:

1. In an apparatus for transferring microwave energy to or from a coaxial cable transmission line having inner and an outer conductors, the improvement comprising: a conductive ring positioned between but spaced from said inner and outer conductors, said ring having two diametrically opposed conductive stubs extending laterally outwardly therefrom, one said stub extending through and electrically separate from said outer conductor, the other said stub extending to and electrically connected with said outer conductor.

2. Apparatus as claimed in claim 1, wherein said ring has dimensions such that the mean circumferential length of said ring is between one quarter and one half wavelength at the design centre wavelength.

3. Apparatus as claimed in claim 1, wherein said line is terminated in its characteristic impedance, said ring comprises a single ring for launching energy into said line terminated in its characteristic impedance, and said stub connected to said outer conductor is one quarter wavelength long at the design center wavelength.

4. Apparatus as claimed in claim 1 which is realised in stripline form.

5. A method of transferring microwave energy to or from a coaxial cable transmission line having inner and outer conductors, comprising: positioning a conductive ring between but spaced from the line's inner and outer conductors, electrically connecting said ring at one circumferential position to the outer conductor to form a short to said outer conductor, and transferring energy to or from said ring via a conductive stub extending laterally outwardly from said ring at a position diametrically opposite the short to said outer conductor.

6. A method as claimed in claim 1, wherein said method is used both in the feeding of energy into the line at an input point and in a subsequent withdrawing of energy from the line some distance away from the input point.

* * * * *